US008640693B2

(12) United States Patent
Löw et al.

(10) Patent No.: US 8,640,693 B2
(45) Date of Patent: Feb. 4, 2014

(54) GAS MASK WITH A DRINKING DEVICE

(75) Inventors: Lothar Löw, Weilrod (DE); Alexander Busch, Lübeck (DE); Dirk Feil, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 149 days.

(21) Appl. No.: 13/230,363

(22) Filed: Sep. 12, 2011

(65) Prior Publication Data

US 2012/0103327 A1 May 3, 2012

(30) Foreign Application Priority Data

Oct. 27, 2010 (DE) ..... 10 2010 049 843
Apr. 21, 2011 (DE) ..... 10 2011 016 805

(51) Int. Cl.
*A62B 18/08* (2006.01)

(52) U.S. Cl.
USPC ..... 128/202.15; 128/201.26; 128/202.27; 128/206.29; 128/912; 285/190

(58) Field of Classification Search
USPC ..... 128/201.11, 201.19, 201.26, 202.13, 128/202.27, 206.22, 206.29; 403/164; 285/190, 272, 321
See application file for complete search history.

(56) References Cited

U.S. PATENT DOCUMENTS

| | | | | | |
|---|---|---|---|---|---|
| 2,400,685 | A * | 5/1946 | Collins | 60/426 |
| 3,461,877 | A * | 8/1969 | Morch | 128/207.14 |
| 3,635,217 | A * | 1/1972 | Potash | 128/201.19 |
| 3,645,261 | A * | 2/1972 | West | 128/201.19 |
| 3,967,838 | A * | 7/1976 | Legris | 285/190 |
| 4,378,795 | A * | 4/1983 | Feathers et al. | 128/202.27 |
| 4,971,048 | A * | 11/1990 | Seekins | 128/202.15 |
| 6,415,789 | B1 * | 7/2002 | Freitas et al. | 128/202.27 |
| 7,198,079 | B2 * | 4/2007 | Kline | 141/353 |
| 2005/0126566 | A1 * | 6/2005 | Stone | 128/202.15 |
| 2006/0180153 | A1 * | 8/2006 | Schaub et al. | 128/206.16 |
| 2008/0093399 | A1 | 4/2008 | Resnick | |

FOREIGN PATENT DOCUMENTS

| | | | |
|---|---|---|---|
| AU | 2007100084 | A5 | 3/2007 |
| EP | 1 132 112 | B1 | 3/2006 |
| EP | 1685877 | A1 | 8/2006 |
| FR | 2326944 | A1 | 5/1977 |
| SE | 454485 | B | 5/1988 |

* cited by examiner

*Primary Examiner* — Clinton T Ostrup
*Assistant Examiner* — Timothy Stanis
(74) *Attorney, Agent, or Firm* — McGlew and Tuttle, P.C.

(57) ABSTRACT

A gas mask with a connection piece (11) at a mask body has an adapter (12), which is rotatably received in the connection piece (11). The gas mask has an angle piece (13) outside the mask that connects to a drinking tube (7) for the consumption of food or beverage and has a mouthpiece within the mask to form a drinking device (2). A swivel joint connection is provided between the adapter (12) and angle piece (13) to accomplish the object.

11 Claims, 4 Drawing Sheets

GAS MASK WITH A DRINKING DEVICE

CROSS REFERENCE TO RELATED APPLICATIONS

This application claims the benefit of priority under 35 U.S.C. §119 of German Patent Applications DE 10 2010 049 843.2 filed Oct. 27, 2010 and DE 10 2011 016 805.2 filed Apr. 21, 2011, the entire contents of which are incorporated herein by reference.

FIELD OF THE INVENTION

The present invention pertains to a gas mask with a drinking device.

BACKGROUND OF THE INVENTION

During long-term missions of members of rescue teams in firefighting or civil protection dehydration occurs at after a short period of time in case of light and heavy respirators. This is due to the breathing of dry air or in a warm environment when wearing protective clothing during high work performance. Depending on severity, dehydration may lead to muscle cramps, a sensation of weakness or even to collapse of the person affected.

To prevent health hazards, larger quantities of liquid must be consumed during the use of the respirator. Since removal of the gas mask is not recommended during use, especially in a contaminated environment, the user of the respirator must be given the possibility of drinking through the mask from a reservoir. The liquid is usually carried along separately in a drinking bottle or a beverage bubble, which is connected to the respirator equipment. Via flexible tubes, the fluid enters the mask, where it can be drunk by the user via a mouthpiece.

Such liquid containers differ essentially in terms of handling. While the drinking bottle is usually carried along in a pocket during the mission or is attached to the clothing by means of a spring hook, the beverage bubble is frequently attached to the carrying harness of the heavy respirator. To rule out the risk of entrainment of contaminants, the drinking bottle may be used in a non-contaminated environment only. In case of a beverage bubble, the ports can only be reached by the user during use with difficulty. When preparing the respirator, the beverage bubble is therefore connected to the drinking port of the mask before the mission. A subsequent contamination via the plug-type connection is ruled out hereby.

The prior-art drinking ports are accommodated mostly in the area of the connection device of the mask for the breathing air supply. The drinking tube is wound around the connection device and is stored in the lower area. There usually is a fixed connection between the mask body and the connection device in order to distribute forces acting on the entire mask from the outside. The mouthpiece of the drinking port is brought in these constructions from the parked position into the drinking position by a lateral rotary motion.

A gas mask with a drinking device is known from EP 1 132 112 B1. An adapter, which is bent at right angles outside the mask and has a nonreturn valve with a closing plug, is attached in a rotatably movable manner in a connection piece attached to the mask body. The adapter is connected within the mask to a mouthpiece, through which the user of the mask can be supplied with liquid or food. It is sometimes difficult for the user of the mask to grasp the mouthpiece with his or her lips when needed in order to consume liquid.

SUMMARY OF THE INVENTION

A basic object of the present invention is to improve a gas mask of the type mentioned in terms of the handling of the drinking device.

According to the invention, a gas mask is provided with a connection piece at a mask body and with an adapter, which is rotatably received in the connection piece. An angle piece is provided outside the mask for the connection of a drinking tube for the consumption of food or beverages. The drinking tube has a mouthpiece within the mask. A swivel joint connection is provided between the adapter and the angle piece.

A swivel joint connection, which causes the positioning of the mouthpiece within the mask and the orientation of the drinking tube in relation to the reservoir for drinking liquid to be uncoupled from one another, is provided according to the present invention between the angle piece for connecting the drinking tube and the adapter leading into the interior space of the breathing mask. The drinking tube can be pivoted towards the reservoir without any change in the position of the mouthpiece in space.

The axes of rotation of the swivel joint connection and those of the adapter in relation to the connection piece preferably extend aligned with one another.

The adapter is advantageously provided in a T-shaped design with a turning knob at the end in such a way that a support ring of a sleeve-like design, which has an opening for the drinking tube, is attached between the turning knob and the connection piece. The support ring is used to absorb overturning moments, which act on the adapter, and to transmit them to the connection piece. The adapter is mechanically stabilized hereby within the connection piece. The larger the external diameter of the turning knob and the external diameter of the support ring, the better is the stabilization. The mouthpiece can be adjusted directly via the turning knob, because the turning knob is connected in one piece with the adapter and the mouthpiece is located at the adapter. The turning knob makes it possible to perform the adjustment of the mouthpiece even with gloves on. Recessed grips may also be arranged on the outside of the turning knob for better operation. The drinking tube can be positioned in a simple manner such that it is gripped directly and brought into the desired position with the gloves on. Only the angle piece is pivoted at the adapter during the change in the position of the drinking tube and the support ring follows the pivoting motion.

An exemplary embodiment of the device according to the present invention is shown in the drawings and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
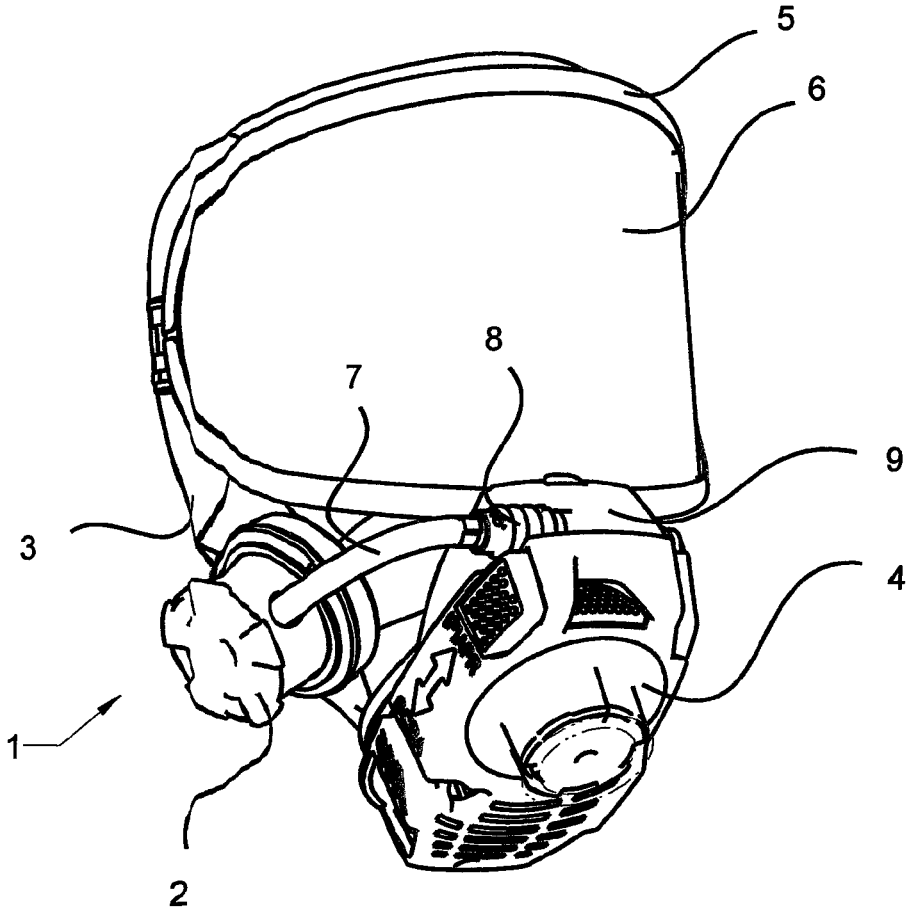
FIG. 1 is a perspective view showing a gas mask according to the invention.

Referring to the drawings in particular, FIG. 1 shows in a perspective view a gas mask 1 with a drinking device 2 at a mask body 3 and at a connection device 4 for a breathing air supply, not shown specifically in FIG. 1. The breathing air may be supplied via a respirator filter, a blower filter device or a pressurized gas supply. The mask body 3 has a peripheral frame 5 with an eye-protecting lens 6. The drinking device 2 has, on the outside of the gas mask 1, a drinking tube 7 with a connection adapter 8 at the end, which can be brought into connection with a reservoir for liquid or food, not shown in greater detail. A hole 9, into which the connection adapter 8 can be plugged in a parked position, is provided on the upper side of the connection device 4. The connection adapter 8 is protected there from contamination and, in addition, it is located in the field of vision of the mask user.

Figure 2:
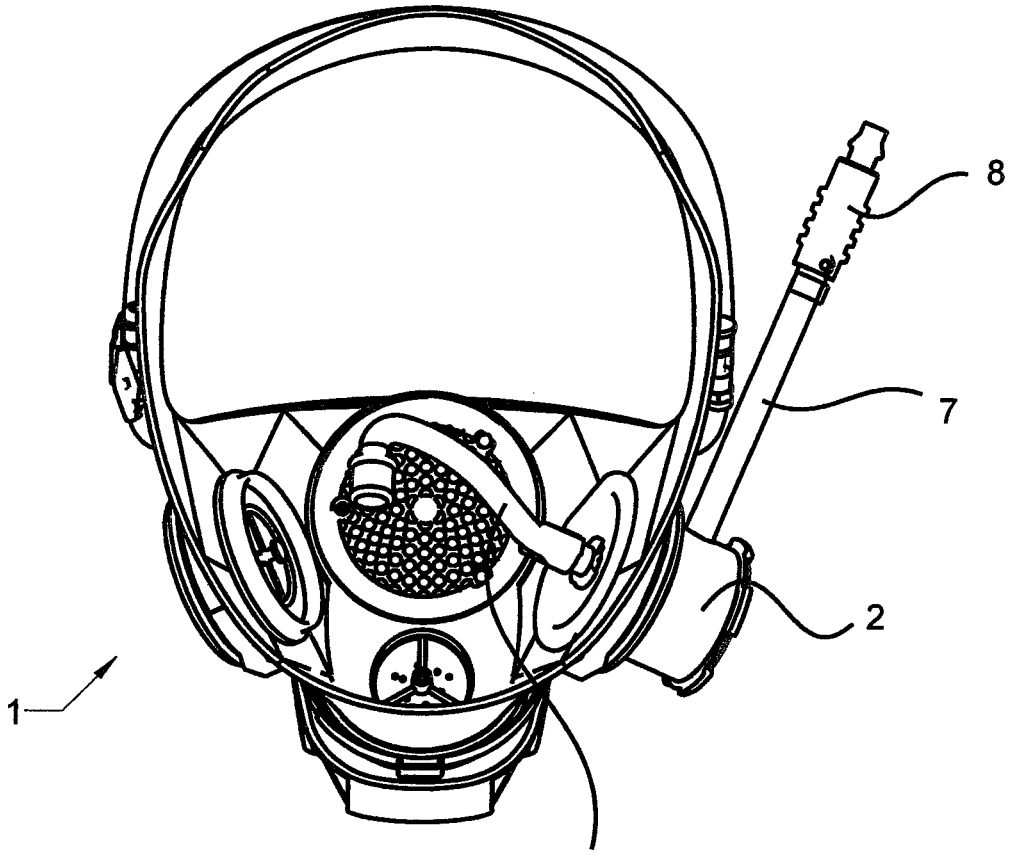
FIG. 2 is a view of the inside of the gas mask according to FIG. 1.

FIG. 2 illustrates an inner view of the gas mask 1 according to FIG. 1. Identical components are designated by the same reference numbers as in FIG. 1. The drinking device 2 has, on the inside of the mask, a mouthpiece 10, through which the mask user can consume liquid or food.

Figure 3:
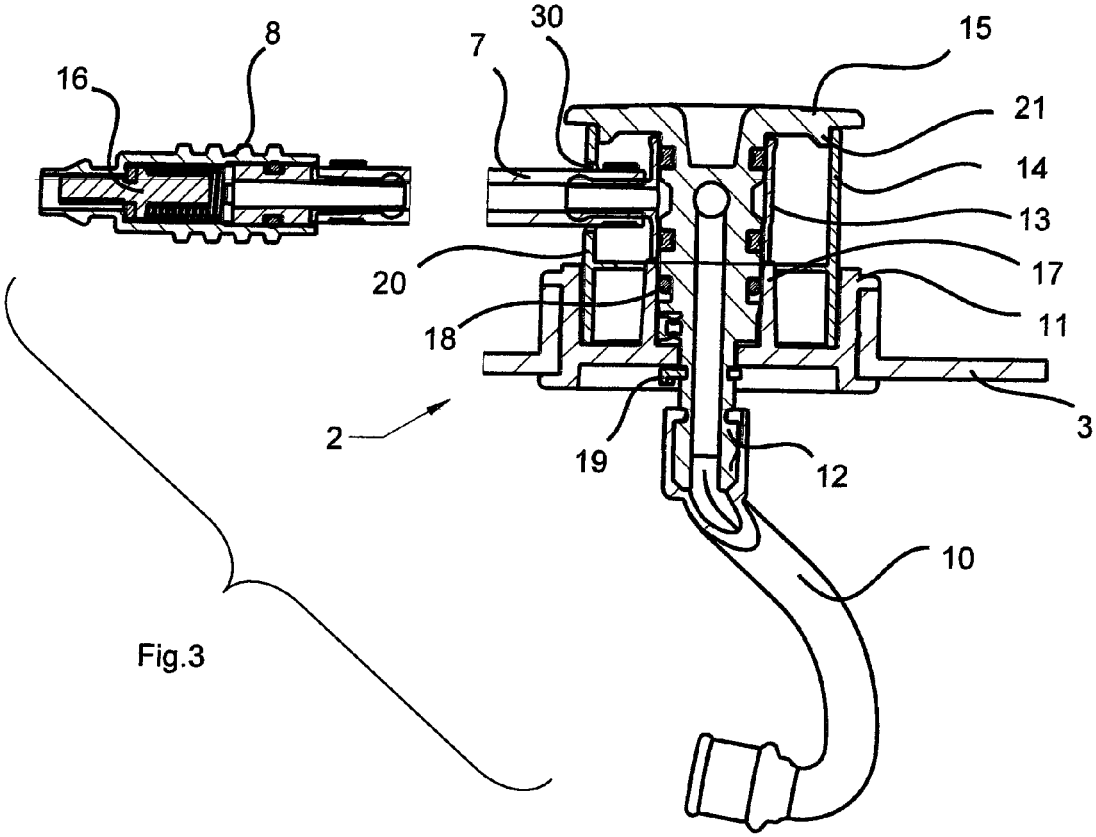
FIG. 3 is a sectional view of a drinking device.

FIG. 3 shows a sectional view of the drinking device 2 according to FIG. 1. The drinking device 2 comprises a connection piece 11, which is attached to the mask body 3 and in which an adapter 12 is accommodated in a rotatably movable manner, an angle piece 13 attached to the adapter 12 in a rotatably movable manner for receiving the drinking tube 7, a support ring 14 between a turning knob 15 at the end of the adapter 12 and the connection piece 11 and the mouthpiece 10 attached to the adapter 12. The connection adapter 8 at the end of the drinking tube 7 has a spring-loaded valve body 16, which is axially displaced during the connection of a reservoir, not shown in more detail, and the passage of liquid through the drinking tube 7 is opened as a result.

The connection piece 11 has an inner sleeve 17 for receiving and centering the adapter 12, and a sealing ring 18 is provided for sealing the gap between the inner sleeve 17 and the adapter 12. A circlip 19, which fixes the adapter 12 within the connection piece 11, is located at the adapter 12 on the underside of the connection piece 11. Support ring 14 is designed as a hollow cylinder and is located, in a rotatably movable manner, in an outer sleeve 20 of the connection piece 11. The turning knob 15 has, on its underside, a guide 21 for receiving the upper end of the support ring 14. The support ring 14 has, in its upper area, a lateral opening 30 for passing through the drinking tube 7. The support ring 14 prevents the adapter 12 from tilting in relation to the connection piece 11. By actuating the turning knob 15 and hence the adapter 12, the position of the mouthpiece 10 within the gas mask 1 can be changed, FIG. 2.

Figure 4:
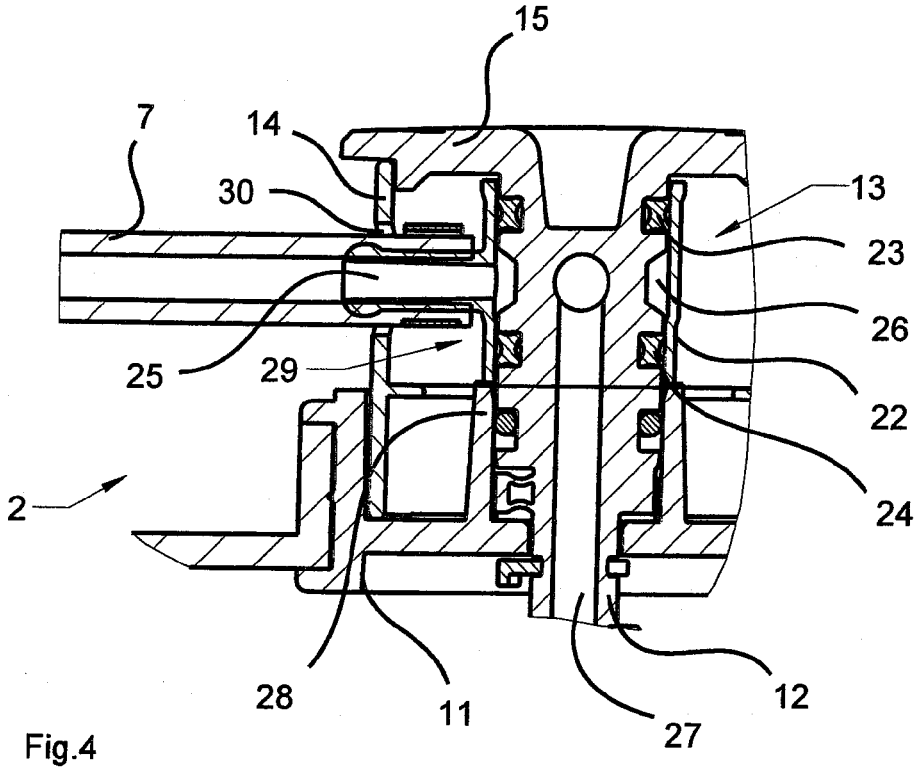
FIG. 4 is an enlarged view of the drinking device according to FIG. 3.

FIG. 4 shows as a detail the upper area of the drinking device 2 in the area of the angle piece 13. The angle piece 13 is attached in a rotatably movable manner to an upper cylindrical section 28 of the adapter 12 by means of a sleeve 22 and has an upper sealing ring 23 and a lower sealing ring 24 between the adapter 12 and sleeve 22. The cylindrical section 28 and the sleeve 22 seated thereon in a rotatably movable manner together form a swivel joint connection 29. A connecting branch 25 at the angle piece 13 connects the drinking tube 7 via a circumferential duct 26 with an inner duct 27 of the adapter 12. Liquid drawn in through the drinking tube 7 can thus flow via the circumferential duct 26 and the inner duct 27 into the mouthpiece 10 (FIG. 3). The sealing rings 23, 24 now seal the circumferential duct 26 against the environment. The angle piece 13 causes the drinking tube 7 to be able to be pivoted in relation to the adapter 12 without any change in the position of the mouthpiece 10 within the gas mask 1. The positioning of the drinking tube 7 is thus fully uncoupled from the setting of the mouthpiece 10, which is performed by means of the turning knob 15. The drinking tube 7 can be pivoted between two end positions, one end position being the drinking position, in which the connection adapter 8 is connected to a reservoir. The drinking tube 7 can be pivoted especially easily between the end positions by the swivel joint connection 29.

While specific embodiments of the invention have been shown and described in detail to illustrate the application of the principles of the invention, it will be understood that the invention may be embodied otherwise without departing from such principles.

APPENDIX

List of Reference Numbers

1 Gas mask
2 Drinking device
3 Mask body
4 Connection device
5 Frame
6 Eyc-protecling lens
7 Drinking lube
8 Connection adapter
9 Hole
10 Mouthpiece
11 Connection piece
12 Adapter
13 Angle piece
14 Support ring
15 Turning knob
16 Valve body
17 Inner sleeve
18 Sealing ring
19 Circlip
20 Outer sleeve
21 Guide
22 Sleeve
23 Upper sealing ring
24 Lower sealing ring
25 Connecting branch
26 Circumferential duct
27 Inner duct
28 Upper cylindrical section
29 Swivel joint connection
30 Opening

What is claimed is:

1. A gas mask comprising:

a mask body defining a mask interior space;

a connection piece at said mask body;

an adapter rotatably received in the connection piece;

an angle piece outside of the mask interior space and rotatable relative to said mask body;

a drinking tube for the consumption of food or beverages, the drinking tube being connected to the angle piece;

a mouthpiece within the mask connected to said drinking tube; and a swivel joint rotatable fluid connection formed between said adapter and said angle piece for rotation of said angle piece relative to said adapter with a sealed fluid passage connection between said adapter and said angle piece; and a support ring with an opening for passing the drinking tube through the support ring wherein said adapter comprises a part with a turning knob at an end, said support ring being attached between said turning knob and connection piece.

2. A gas mask in accordance with claim 1, wherein axes of said swivel joint connection and said adapter extend aligned with one another in relation to the connection piece.

3. A gas mask in accordance with claim 1, further comprising a fastening device for fastening the drinking tube to the mask body.

4. A gas mask in accordance with claim 3, wherein the fastening device is arranged in a field of vision of the mask user.

5. A protective mask comprising:

a mask body defining a mask interior space;

an adapter rotatably mounted with respect to the mask body;

an angle piece outside of the mask interior space and rotatable relative to the mask body and rotatable relative to the adapter;

a drinking tube for the consumption of food or beverages, the drinking tube being connected to the angle piece;

a mouthpiece within said interior space, said mouthpiece being connected to said adapter, said adapter and said angle piece forming a swivel joint connection with said adapter and said angle piece defining a rotatable sealed fluid connection between said drinking tube and said mouthpiece;

a connection piece connected to said mask body and connected to said adapter, said adapter being rotatably mounted to said connection piece whereby said mouthpiece may be rotated relative to said mask body;

wherein said swivel joint connection has a swivel joint axis of rotation; said adapter has an adapter axis of rotation; and said swivel joint axis of rotation and said adapter axis of rotation extend aligned with one another in relation to the connection piece; and a support ring with an opening for passing the drinking tube through the support ring wherein said adapter comprises a part with a turning knob at an end, said support ring being attached between said turning knob and connection piece.

6. A protective mask in accordance with claim 5, further comprising a fastening device for fastening the drinking tube to the mask body.

7. A protective mask in accordance with claim 6, wherein:

the mask body has an eye-protecting lens providing a field of vision of the mask user outside of the mask body; and the fastening device is arranged in a field of vision of the mask user.

8. A protective mask comprising:

a mask body defining a mask interior space;

an adapter mounted to the mask body for rotation relative to the mask body;

an angle piece rotatable relative to the mask body and rotatable relative to the adapter;

a drinking tube connected to the angle piece;

a mouthpiece connected to said adapter and extending into said mask interior space, said adapter and said angle piece forming a swivel joint connection with said adapter and said angle piece defining a rotatable fluid connection between said adapter and said angle piece and between said drinking tube and said mouthpiece;

a connection piece connected to said mask body and connected to said adapter, said adapter being rotatably mounted to said connection piece whereby said mouthpiece may be rotated relative to said mask body; and a support ring with an opening for passing the drinking tube through the support ring wherein said adapter comprises a part with a turning knob at an end, said support ring being attached between said turning knob and connection piece.

9. A protective mask in accordance with claim 8, wherein:

said swivel joint connection has a swivel joint axis of rotation;

said adapter has an adapter axis of rotation; and said swivel joint axis of rotation and said adapter axis of rotation extend aligned with one another in relation to the connection piece.

10. A protective mask in accordance with claim 8, further comprising a fastening device for fastening the drinking tube to the mask body.

11. A protective mask in accordance with claim 10, wherein:

the mask body has an eye-protecting lens providing a field of vision of the mask user outside of the mask body; and the fastening device is arranged in a field of vision of the mask user.

* * * * *

UNITED STATES PATENT AND TRADEMARK OFFICE

CERTIFICATE OF CORRECTION

PATENT NO. : 8,640,693 B2
APPLICATION NO. : 13/230363
DATED : February 4, 2014
INVENTOR(S) : Lothar Low et al.

It is certified that error appears in the above-identified patent and that said Letters Patent is hereby corrected as shown below:

Title Page, Item (30) Foreign Priority Data date should read:

Foreign Application Priority Data April 12, 2011 (DE) 10 2011 016805

Signed and Sealed this
Thirteenth Day of May, 2014

Michelle K. Lee

Michelle K. Lee
*Deputy Director of the United States Patent and Trademark Office*